United States Patent [19]

Young

[11] Patent Number: 4,832,372

[45] Date of Patent: May 23, 1989

[54] PORTFOLIO

[75] Inventor: Raymond W. Young, West Bend, Wis.

[73] Assignee: Amity Leather Products Co., West Bend, Wis.

[21] Appl. No.: 176,303

[22] Filed: Mar. 31, 1988

[51] Int. Cl.[4] ..... B42D 3/00; B42D 3/04; A45C 1/08; A45C 15/02

[52] U.S. Cl. ..... 281/31; 281/17; 150/139; 150/147

[58] Field of Search ..... 281/3, 4, 16, 17, 19, 281/31; 206/387, 39.7, 39.2, 492, 493, 472, 450; 150/52 B, 145, 151.31, 151.47, 151.49, 147, 148, 149, 152, 139

[56] References Cited

U.S. PATENT DOCUMENTS

| | | | |
|---|---|---|---|
| D. 241,381 | 9/1976 | Garnier | 281/31 |
| 2,228,457 | 1/1941 | Hoople | 150/139 |
| 2,982,322 | 5/1961 | Seitz | 150/139 |
| 3,187,795 | 6/1965 | Stephenson | 150/147 |
| 3,435,868 | 4/1969 | Stermer | 150/147 |
| 3,565,148 | 2/1971 | Miller | 150/147 |
| 4,639,157 | 1/1987 | Herzfield | 281/31 |
| 4,704,042 | 11/1987 | Eisen et al. | 150/52 B |
| 4,743,049 | 5/1988 | Wiberg | 281/17 |

*Primary Examiner*—Frank T. Yost
*Assistant Examiner*—Paul M. Heyrana, Sr.
*Attorney, Agent, or Firm*—Fitch, Even, Tabin & Flannery

[57] ABSTRACT

Disclosed is a portfolio comprising a body of sheet-like material having a central hinge line dividing the body into first and second covers. A foldable panel is hingeably attached to the first cover, and has a surface carrying a serial array of card-receiving pockets which are exposed to a user when the foldable panel is folded away from the first cover. In one embodiment, the portfolio includes an interior section forming a pocket with the first cover. The foldable panel divides the pocket into two chambers when disposed on either side of the foldable panel. In a second embodiment, the interior section comprises an integral extension of the foldable panel being joined thereto by an interior hinge line.

8 Claims, 3 Drawing Sheets

PORTFOLIO

BACKGROUND OF THE INVENTION

1. Field of the Invention

The present invention pertains to portfolios, briefcases and the like for carrying notes, writing paper, and appointment cards.

2. Description of the Prior Art

Students, salesmen, and peopel in many other walks of life find it convenient to carry a tablet of writing paper from place to place. In order to protect the tablet of writing pater, portfolios, briefcases and the like in which the tablet of writing paper is inserted, have been provided.

Other types of products have been provided to help salesmen, business executives, and others to keep track of personal appointments that may be made throughout the course of a day or week. Pre-printed booklets have been provided for displaying a page or a section of a page associated with each workday, for example. Various notes can be entered in the writing space allocated for each workday. Of course, the entry for each appointment would usually require at least the name of the person with whom an appointment has been made. Frequently, this information and other important information such as the company name, address, and telephone number of the person to be visited are copied from the business card which usually has the customary size of approximately two inches by three and a half inches. Typically, in addition to transcribing a portion of the information contained on the business card, the business card will also be retained by the person making the appointment. However, the person usually carries a number of such business cards and is presented with the problem of retrieving a particular business card upon demand.

Regarding portfolio devices in general, although it is usually desirable to have as many pockets in a portfolio as is possible, it is generally desirable that the portfolio have the approximate dimensions of a tablet of writing paper. Thus, the portfolio itself and especially any internal divider portions thereof are preferably made of relatively thin sheet-like materials. Typically, the more desirable portfolios are made from relatively expensive materials, notably leather. Although advances have been made in providing leather sheet stock of economical thickness, leather materials are relatively expensive and the goods produced from leather materials usually require an added labor expense of assembling individual small sheets of leather in a completed article. If the thickness of a portfolio is to be kept to a minimum, any seams must be eliminated wherever possible. Even if the overall thickness of the portfolio is not greatly increased, when a number of pockets are added thereto, the labor associated with forming such pockets adds significantly to the cost of the article produced.

It is frequently desirable to provide additional features in a portfolio used to organize a person's time. One feature popular today, for example, is the inclusion of an electronic calculator which is typically carried in a pocket formed in the interior of a checkbook or the like device. For leather checkbooks, a pocket is usually formed from an additional piece of leather and, in any event, the pocket requires additional stitching or the like for attachment to a surface of the checkbook, usually by stitching.

One tool that is becoming increasing popular today for organizing papers and the like and for making and attaching temporary notes on an article are tablets of note paper having a band of low-tack adhesive applied at an end of one surface thereof. One example of such notes is sold under the trademark Post-It of the 3M Corporation. Although it is well known to apply such notes directly to writing papers, books and the like, further uses of such temporary note materials for organizing a person's appointment schedule are in popular demand.

SUMMARY OF THE INVENTION

It is an object of the present invention to provide a portfolio of improved economical construction formed with a minimum number of operations and yet providing a relatively large number of pockets for holding business cards, notes, papers, and the like.

Another object of the present invention is to provide a portfolio for carrying a writing tablet and having provision for also carrying an electronic calculator without requiring a pocket therefor.

A further object of the present invention is to provide a series of pockets for displaying business cards and the like in a manner which helps organize the person's work day or work week and which provides ready retrieval of the business card or the information printed thereon.

A further object of the present invention is to provide a series of pockets of the above-described type for carrying a plurality of business cards, which is compatible with low-tack adhesive notes which can be associated with each business card.

These and other objects of the present invention which will become apparent from studying the appended description and drawings are provided in a portfolio having a sheet-like body consisting of opposed top and bottom edges and a pair of opposed side edges. A central hinge line, located intermediate and generally parallel to the side edges, divides the sheet-like body into first and second covers, foldable toward each other to a closed position so as to at least partially overlie each other, and foldable away from each other to an open position. The first and second covers have interior surfaces facing each other when the portfolio is in the closed position. A foldable panel, having top and bottom edges adjacent the top and bottom edges of the first cover, is hingeably mounted to the body so as to be foldable along an interior hinge line intermediate and generally parallel to one side edge of the first cover and the central hinge line. The foldable panel has a first surface facing the first cover interior surface when folded thereagainst, and a second opposed surface. The first surface of the foldable panel carries a serial array of card-receiving pockets, and opens toward the central hinge line when the panel is folded, so that the first surface thereof faces away from the first cover inside surface.

Other objects of the present invention are provided in a portfolio of the above-described type further comprising an interior section attached to the first cover so as to at least partially overlie the inside surface thereof, forming a first pocket therewith. The interior section extends between the top and bottom edges of the body and opens toward the central hinge line. A portion of the foldable panel extends into the pocket and divides it into two chambers, one disposed on each side of the foldable panel.

Still further objects of the present invention are provided by a portfolio of the first-described type further comprising an interior section attached to the first cover so as to at least partially overlie the inside surface thereof, forming a first pocket therewith. The interior section extends between the top and bottom edges of the cover member and opens toward the central hinge line. The foldabe panel comprises an extension of the interior section and is separated therefrom by the interior hinge line. The interior section and the foldable panel together comprise a unitary sheet which overlies the first cover when the foldable panel is folded thereagainst, the second panel overlying the foldable panel when the portfolio is closed.

BRIEF DESCRIPTION OF THE DRAWINGS

In the drawings, wherein like elements are referenced alike.

DETAILED DESCRIPTION OF THE PREFERRED EMBODIMENTS

Figure 1:
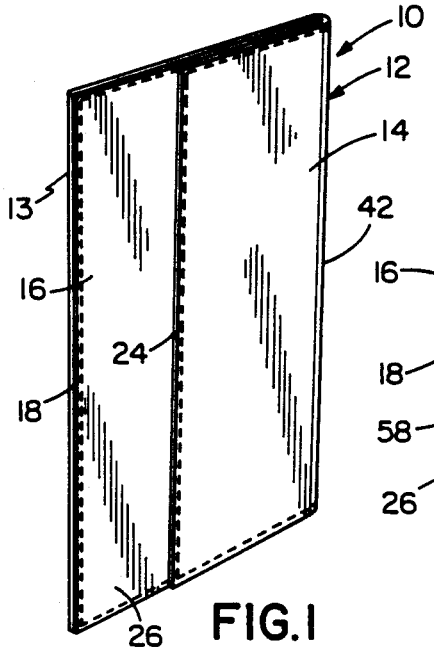
FIG. 1 is a perspective view of a portfolio illustrating a first embodiment of the present invention.
Figure 2:
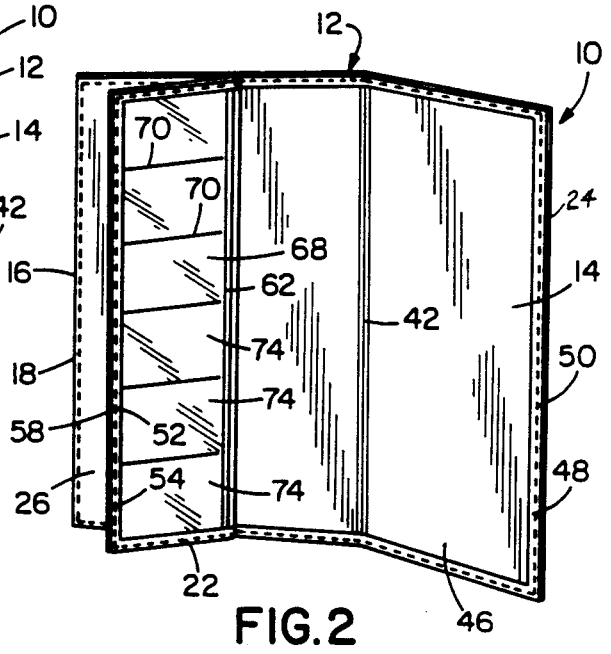
FIG. 2 is a perspective view of the portfolio of FIG. 1 shown in an opened position.

Referring now to the drawings, and especially to FIG. 1, the first embodiment of a portfolio constructed according to principles of the present invention is generally indicated at 10. The portfolio 10 is preferably constructed from a unitary sheet-like body 11 including a first, back cover 12 and a front cover 14. Body 11 has two side edges 13, 24, one at the free edge of each cover 12 and respectively 14. An interior section 16 is attached at its outer periphery to cover 12 by stitching 18 which extends along the marginal edges of the cover 12.

Figure 4:
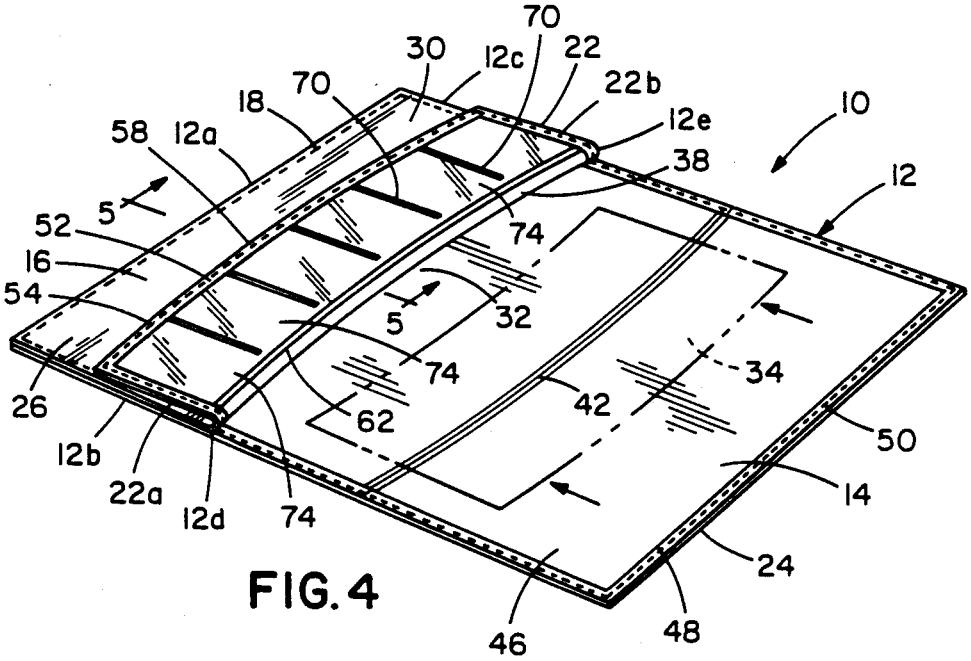
FIG. 4 is a perspective view of the portfolio FIGS. 1-3 illustrating the use of a second pocket formed in the portfolio.
Figure 5:
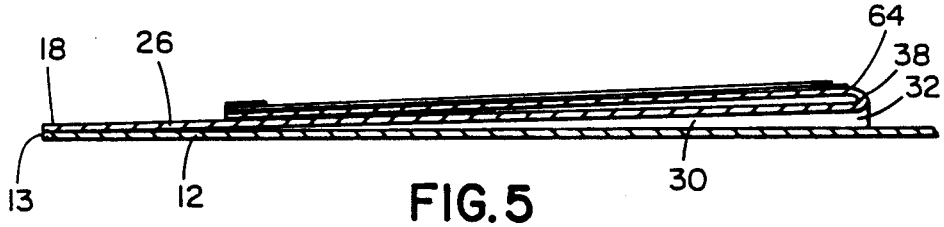
FIG. 5 is a fragmentary cross-sectional view taken along the line 5—5 of FIG. 4.

Referring to FIG. 4, the stitching 18 extends along a lateral edge 12*a* of cover 12 and along the partial stitching portions 12*b*, 12*c* of the top and bottom marginal edges of the cover 12 to define the stitched portion 26 of interior section 16. As is clearly illustrated in FIG. 4, the partial stitching portions, 12*b*, 12*c* terminate at points 12*d*, 12*e* with the remainder of the interior section 16 forming a foldable panel 22. The interior section 16 of the preferred embodiment is divided into the stitched portion 26 and the foldable panel 22.

Referring briefly to FIG. 1, when the portfolio is in the folded or closed position as illustrated in FIG. 1, the front cover 14 completely covers the foldable panel 22 with the free edge 24 of the front cover 14 (and the body 11) extending slightly into the stitched portion 26 of interior section 16.

As illustrated in FIG. 4, the stitched portion 26 of interior section 16 is attached to cover 12 by stitching 18 so as to form a first pocket 30 having an opening 32, suitable for receiving a sheet of paper such as the sheet 34 illustrated in phantom in FIG. 4. The foldable panel 22 is joined to the stitched portion 26 by an inside flexible fold line or hinge 38. In the preferred embodiment, the stitched portion 26 and the foldable panel 22 are preferably formed from a unitary sheet of flexible material which, when attached to the cover 12 in the manner described above with respect to stitching 18 can be folded to form the hinge 38 without need of further construction.

The back cover 12 and front cover 14 are, like the stitched portion, preferably formed from a unitary sheet of flexible material so as to be foldable about an outside fold line or hinge 42, so as to provide an economical construction, particularly when the resilient material comprises leather goods and the like.

The back cover 12 and front cover 14 of the preferred embodiment are lined with a unitary cloth lining material 46 secured at its outer periphery with a turned edge 48 and stitching 50. The lining material may be omitted if the interior surface 51 of the body 11 presents an attractive appearance. The edges of the front and back covers are finished with a folded or turned edge 52 of front cover free edge, secured by stitching 54.

Figure 6:
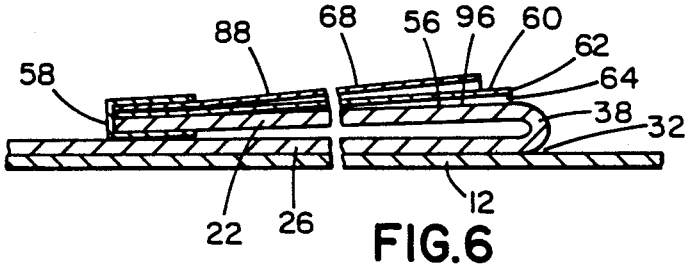
FIG. 6 is a fragmentary cross-sectional view taken along the line 6—6 of FIG. 3.
Figure 7:
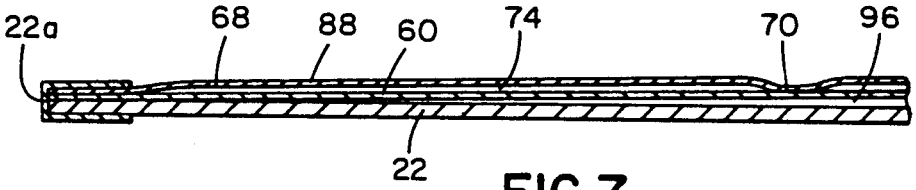
FIG. 7 is a fragmentary cross-sectional view taken along the line 7—7 of FIG. 3.

Referring to FIGS. 6 and 7, a backing sheet 60 is attached at three of its four marginal edges to the interior surface 56 of foldable panel 22. Referring to FIG. 4, the three marginal edges of the backing sheet are attached to the top and bottom edges 22*a*, 22*b* and the lateral free edge 58 of the foldable panel. The backing sheet 60 has a free edge 62 which lies adjacent hinge 38 of internal flap 22. The backing sheet 60 accordingly forms a second pocket of the portfolio which has an opening 64 adjacent to free edge 62 and hinge 38.

Overlying the backing sheet 60 is a top sheet 68 which also extends between the top and bottom edges of foldable panel 22, but which is preferably slightly narrower than the backing sheet 60. The top sheet 68 is joined to the backing sheet 60 at a plurality of spaced-apart, generally parallel line segments 70, so as to form a plurality of card-receiving pockets 74. Top sheet 68 has a free edge 76 adjacent the free edge 62 of backing sheet 60 and hinge 38.

The line segments 70 divide the pocket formed by the backing sheet 60 and top sheet 68 into a serial array of individual pockets 74. As will be seen, some of the line segments can be configured to provide only a visual division between adjacent pockets, as opposed to a physical barrier, as when the line segments define a line of bonding between sheets 60, 68. The pockets 74 each have openings 80 through which a card, such as a business card 82, may be inserted (See FIG. 3). The top sheet 68 and backing sheet 60 is preferably formed of plastic sheet materials to provide a convenient joinder along line segments 70, dividing adjacent pockets 74. The top sheet 68 is preferably formed of a clear plastic material which is transparent so as to allow ready visual observation of business cards and the like received in the pockets 74, without requiring the cards to be extracted therefrom.

According to another aspect of the present invention, the pockets 74 bear indicia such as the lettering 86 which uniquely identifies each pocket 74. For example, the lettering illustrated in FIG. 3 corresponds to the days of the business week, with each pocket corresponding to a particular weekday. Thus, the user of the portfolio can arrange business appointments for each day by merely inserting the appropriate business cards in each respective pocket 74. The information on each business card is readily retrievable merely by folding over foldable panel 22, so as to expose the transparent top sheet 68 and the business card or other material directly thereunderneath, to view.

Figure 3:
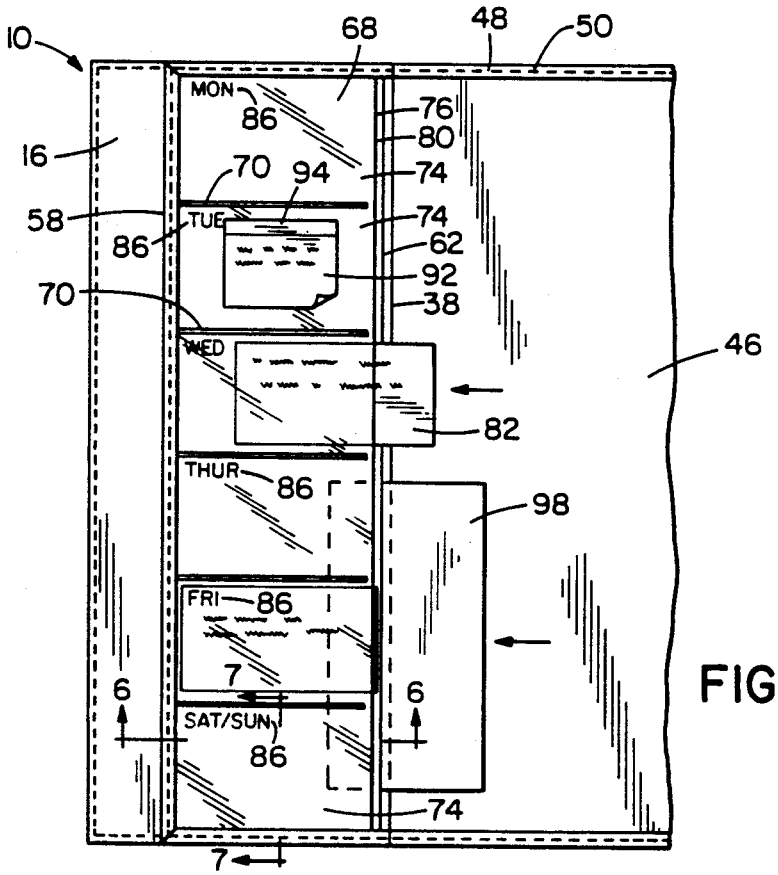
FIG. 3 is an elevational view of the left hand portion of FIG. 2 shown on an enlarged scale.

As an additional feature of the present invention, the top sheet 68 is preferably formed with a continuous nonperforated, nonporous upper surface 88 suitable for the ready attachment of an adhesive-bearing note thereto. For example, FIG. 3 illustrates a note 92 having a band of low-tack adhesive 94 at one end thereof. Notes having a size smaller than a conventional business card are readily available, and may conveniently be used with the portfolio according to the present invention to provide a convenient temporary note pertaining to a particular appointment. If desired, the bottom end of the note could be lifted for a more complete view of the business card or the like thereunderneath, if desired.

As is well known in the plastics molding art, plastic material preferably includes a certain oil content which is continuously released from the surface of the plastic during the life of the molded plastic part. According to one aspect of the present invention, the top cover sheet 68 is preferably formed of any suitable, known plastics material using known plastic molding processes which greatly reduce the release of oil at the upper surface thereof. The presence of such oil would of course would, of course, detract from the ability of an adhesive to bond thereto and would be particularly unattractive to even temporarily bond a low-tack adhesive thereto.

The pocket 96 formed between backing sheet 60 and foldable panel 22 is suitable for receiving a note or other paper article such as the bank check 98 illustrated in FIG. 3. Thus, a plurality of pockets are provided on the foldable panel 22 without adding substantially to the bulk thereof, providing an attractive low profile portfolio construction.

As indicated most clearly in FIG. 6, the portfolio constructed according to the present invention provides a plurality of overlying pockets formed by internal sheet-like members sewn or otherwise affixed together with a minimal labor investment. Each of the pockets of the portfolio 10 open in the same direction, generally toward the fold line 42 joining the cover 12 and front cover 14. Further, as can be seen with reference to FIG. 6, the openings of overlying pockets are laterally offset from the underlying pockets so as to provide a ready visual observation of their position in the layered stack of pockets. The lateral offsets, as can be seen in FIG. 6, increase in magnitude as the topmost pockets 74 are approached. Thus, the open, free end portion of the bottom-most wall of each pocket protrudes slightly beyond the topmost wall of the pocket, to provide a readily observable indication of the pocket opening. In the portfolio illustrated in FIGS. 1–7, two pockets are provided in addition to the serial array of card-receiving pockets 74, all within a portfolio construction of minimal thickness.

Figure 8:
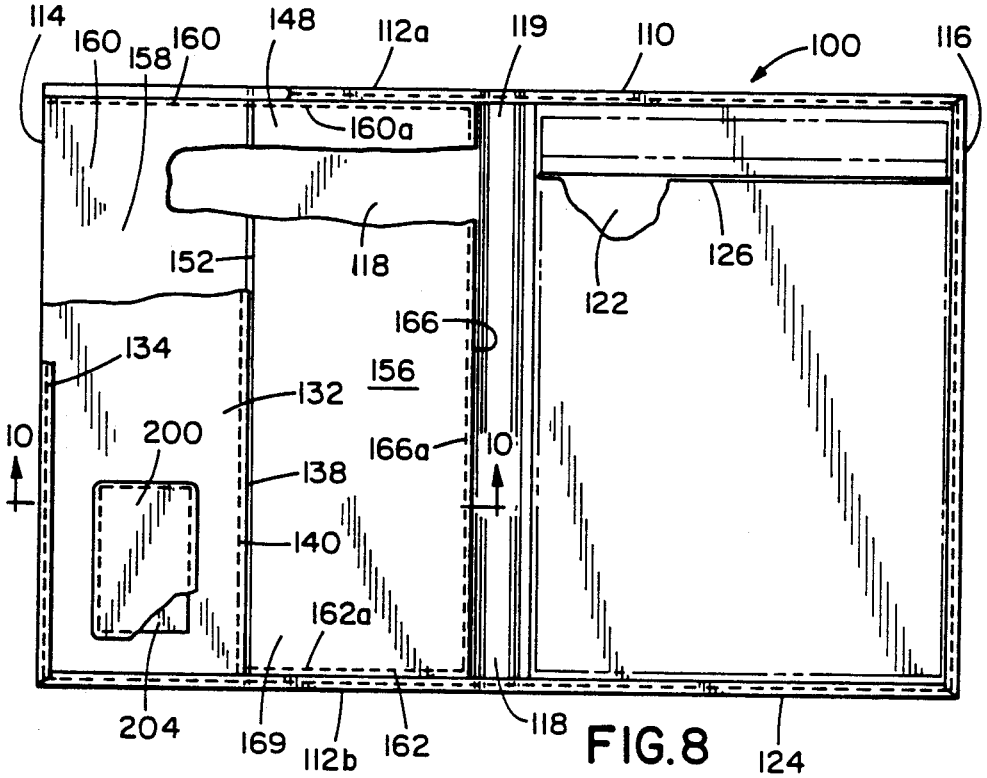
FIG. 8 is a elevational view of the portfolio illustrating a second embodiment according to the present invention.
Figure 9:
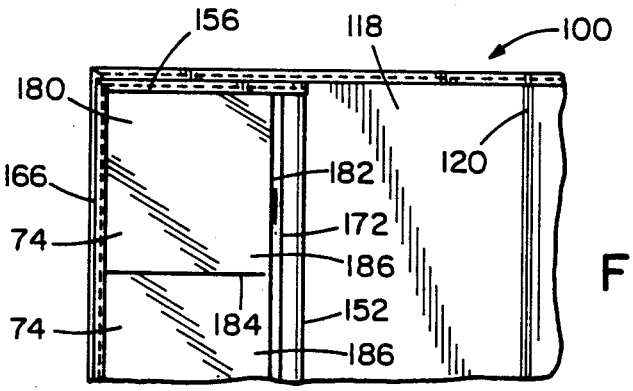
FIG. 9 is a fragmentary view of the portfolio of FIG. 8 which is opened to its expose the serial array of card-carrying pockets.
Figure 10:
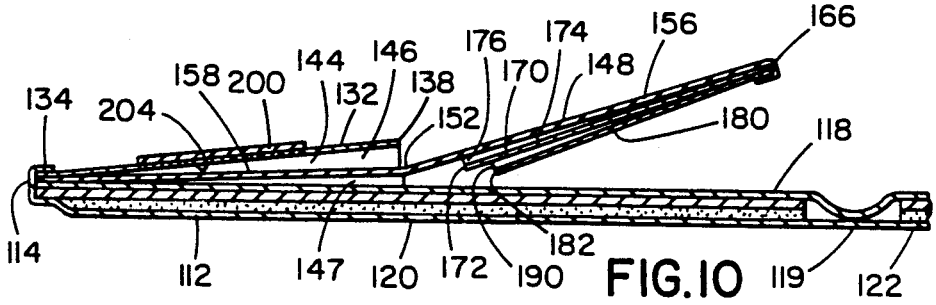
FIG. 10 is a cross-sectional view taken along the line 10—10 of FIG. 8

Referring now to FIGS. 8–10, a second embodiment of a portfolio according to the principles of the present invention is generally indicated at 100. Portfolio 100 preferably includes a unitary body 110 having top and bottom marginal edges 112*a*, 112*b* and side marginal edges extending between the lateral edges 114, 116 of the portfolio. Like the portfolio of the preceding FIGS. 1–7, the body member 110 of portfolio 100 is covered by an inside liner 118 which, in combination with the body member, defines a fold line or hinge 119. Hinge 119 divides the portfolio into front and back covers 120, 122 which are generally of equal size so that when the portfolio is folded about hinge line 119 to a folded or closed configuration, the lateral free edges 114, 116 are immediately adjacent one another.

The portion of liner 118 overlying the back cover 122 has a generally horizontal slit 126 formed therein so as to accommodate a bottom leaf of a writing tablet which is telescopically inserted in a pocket formed between a portion of the inside liner 118 and the back cover 122. In use, the rear leaf of the writing tablet is telescopically inserted through an opening or slit 126 which provides access into the pocket. If desired, the liner material for the back cover 122 can be made of a stronger or other more suitable material different from that which would be chosen merely for aesthetic purposes. In the preferred construction of portfolio 100, no similar pockets are formed in the front cover 120.

An interior panel 132 is preferably attached along three of its marginal edges to the front cover 120. The interior panel is preferably formed by attachment to the top and bottom edges 112*a*, 112*b* of body 110 and to the lateral edge 114 of the portfolio. In the preferred embodiment the front cover 120 is turned or folded over the marginal edges of interior panel 132 and is attached thereto with a stitching 134. Alternatively, a piping may be used at the marginal edges, prior to the stitching operation. The remaining edge 138 of panel 132 comprises a free edge, with the stitching 140 shown thereat being provided for the mounting of card-carrying pockets similar to those described above, but does not indicate attachment to the front cover of the portfolio. Although shown partially broken away in FIG. 8, interior panel 132 of the preferred embodiment extends between the top and bottom edges 112*a*, 112*b* of the front cover member. Preferably, the three attached marginal edges of the interior panel 132 are secured to the front cover in a single operation, which also joins the inside liner 118 and any liner that may be provided on the hidden interior surface of the interior panel.

The interior panel 132 forms a pocket 144 with the inside liner 118, which it directly opposes. As illustrated in the figures, the interior panel 132 only partially overlies the front cover, such that the free edge 138 of the interior panel is spaced a substantial distance away from the central hinge line 119. Easy access is accordingly provided to the pocket 144 which opens towards the central hinge line 119.

The portfolio 100 of the second embodiment is characterized in one respect by an internal wall 148 preferably made of flexible material having a fold or hinge line 152 dividing the wall into a foldable panel 156 and a divider panel portion 158. The divider panel portion 158 has a lateral free end 160 preferably attached to the cover 112 by the stitching 134, which extends along the lateral edge 114 of the portfolio. Preferably, this is the only point of attachment of the divider panel porton with the remainder of the portfolio.

According to one aspect of the present invention, the divider panel portion 158 is preferably inserted within the pocket 144 prior to its attachment along the lateral free edge of the portfolio by stitching 134. Thus, the remaining three peripheral edges of interior wall 148 are free and unattached. More particularly the upper and lower free edges 160, 162 remain free and unattached as does the lateral free edge 166 which, as shown in FIG. 8 is disposed adjacent the hinge 119. The stitching 160*a*, 162*a*, and 166*a* along the free edges of the interior wall are, in the preferred embodiment, utilized only to secure a fabric linear material to the internal wall and such stitching is accordingly optional to the portfolio construction.

Preferably, the internal wall 148 is flexible as mentioned above, so as to form a resilient hinge or fold line 152 located immediately adjacent the free edge 138 of the interior panel 132. Thus, the foldable panel 156 can be folded over so that its first surface 169, visible in FIG. 8, overlies and contacts the exposed surface of interior panel 132.

Referring again to FIG. 10, the packing sheet 170 generally coextensive with the foldable panel 156 is attached at its upper and lower edges and at one lateral edge to the marginal free edges of foldable panel 156. The backing sheet 170 has a first lateral edge attached to foldable panel 156 adjacent the free edge 166 thereof. The remaining edge 172 of the backing sheet is a free edge located adjacent the hinge line 152. The backing sheet 170 forms a pocket 174 with the foldable panel 156, the pocket having an opening 176. When foldable panel 156 is folded into the position illustrated in FIG. 9, the pocket 174 opens toward the hinge 119 of the portfolio, that is, it opens in the same direction as the pocket 144 formed by internal panel 132. Thus, with a single point of attachment, the interior wall 148 divides pocket 144 into two sub-pockets 146, 147 lying on either side of the divider panel portion 158.

Overlying the backing sheet 170 is a top sheet 180 generally coextensive with a backing sheet but having a smaller width-wise dimension. The top sheet 180 is joined along three of its four marginal edges, by stitching 160*a*, 162*a*, and 166*a*. The lateral free edge 182 of top sheet 180 is laterally offset from free edge 172 of backing sheet 170. The top sheet 180 and backing sheet 170 are joined along a plurality of generally parallel divider lines or line segments 184 so as to form a serial array of discrete card-receiving pockets 186. The pockets each share the lateral free edge 182 of top sheet 180 and having openings 190 thereat. With the foldable panel 156 folded into the open position of FIG. 9, the openings 190 of the pockets 186 extend toward the hinge 119 of the portfolio, as do the remaining three pockets 174, 146, and 147, described above.

Although only a fragment of the serial array of card-receiving pockets 186 is illustrated in FIG. 9, the remaining portions of the card-receiving pockets are identical to the construction illustrated above with respect to FIGS. 1–7. More particularly, the foldable panel 156, the backing sheet 170, and the top sheet 180 are substantially identical to the foldable panel 22, backing sheet 60, and top sheet 68 described above, and also the pockets 186 are substantially identical to the pockets 74. One distinction between the second embodiment of FIGS. 8–10 and the first embodiment of FIGS. 1–7 is that the interior wall 148, formed as a single unitary sheet of material, with one point of attachment to the cover, divides the pocket 144 into two sub-pockets and also provides a hingeable mounting of the card-carrying pockets and the pocket 174 without requiring further attachment to the main body portion of the portfolio. Thus, the backing wall 148, the backing sheet 170, and the top sheet 180 can be conveniently formed as a subassembly separate from the remaining portion of the portfolio. As will be apparent to those skilled in the art, the separate subassembly manufacture afforded by the present invention results in significant reductions in labor investments further contributing to the economical construction of the portfolio.

Referring again to FIGS. 8 and 10, a portfolio 100 provides an improved low profile attachment for a peripheral accessory such as an electronic calculator 200. A magnetic disk 204 is embedded in the interior panel 132. Disk 204 has an upper exposed surface generally coplanar with the upper exposed surface of interior panel 132 visible, for example, in FIG. 8. The magnetic disk 204 is preferably formed from a thin plastic material in which is embedded ferrous magnetic materials such as iron fillings, so as to provide a disk of low profile or thin construction which does not contribute significantly to the thickness of the interior panel 132 and which does not obstruct the interior volume of the pocket portion 146. The electronic calculator 200 preferably includes a metallic backing of a type which is readily magnetically removably attached to the disk 204.

One modification contemplated by the present invention is that every other line segment of bonding between the top and backing sheets can be eliminated, with effective card retention still being provided by the remaining line segments along which the top and backing sheets are bonded. Thus, the line segment 184 of FIG. 9 can comprise a divider line painted onto the top sheet 180 which is suggestive in appearance of the line segments along which the top sheet 180 and the backing sheet 170 are bonded together to form an inter-pocket divider. Thus, in one embodiment, the card-receiving pockets of portfolio 100 are substantially identical to that illustrated in FIG. 3 except that the bonded line segments adjacent the indicia "WED" and "FRI" are replaced by painted lines in the manner described above. This allows slightly oversized cards to be positioned one partially overlying another within the card-receiving pockets resulting from the modified construction. As before, the top sheet 180 is preferably formed of an imperforate nonporous surface suitable for ready bonding with an adhesive, such as an adhesive carried on the back of a paper note.

It will thus be seen that the objects herein set forth may readily and efficiently be attained and, since certain changes may be made in the above construction and different embodiments of the invention can be made without departing from the scope thereof, it is intended that all matter contained in the above description or shown in the accompanying drawings shall be interpreted as illustrative and not in a limiting sense.

What is claimed is:

1. A portfolio comprising:

a sheet-like body having opposed top and bottom edges and a pair of opposed side edges, a central hinge line intermediate the side edges and generally parallel thereto, dividing the sheet-like body into first and second covers foldable toward each other to a closed position so as to at least partially overlie each other and foldable away from each other to an open position, the first and second covers having interior surfaces facing each other when said portfolio is in said closed position;

a foldable panel having top and bottom edges adjacent the top and bottom edges of the first cover, said foldable panel hingeably mounted to the body so as to be foldable along an interior hinge line intermediate one side edge of said first cover and said central hinge line, and generally parallel thereto, said foldable panel having a first surface facing the first cover interior surface when folded thereagainst and a second opposed surface; and a serial array of card-receiving pockets carried on the first surface of said foldable panel, opening toward said central hinge line when said panel is folded so that the first surface thereof faces away from said first cover inside surface.

2. The portfolio of claim 1 further comprising an interior section attached to the first cover so as to at least partially overlie the inside surface thereof, and so as to form a first pocket therewith, extending between the top and bottom edges of the body and opening toward said central hinge line, a portion of said foldable panel extending into said pocket so as to divide said pocket into two chambers, one disposed on each side of said foldable panel.

3. The portfolio of claim 2 wherein the interior section has an exposed surface facing in the same direction as said front cover interior surface, and said portfolio further comprises mounting means in said interior section having an exposed surface for releasably mounting a calculator.

4. The portfolio of claim 2 wherein said interior section and said foldable panel are secured to the side edge of said front cover with common stitching means extending therethrough.

5. The portfolio of claim 1 wherein said portfolio further comprises a backing sheet on which said card-receiving pockets are carried, said backing sheet having top and bottom edges attached to the foldable panel adjacent the top and bottom edges thereof so as to form a pocket therewith opening toward said central hinge line when said foldable panel is folded so that the first surface thereof faces away from said front cover inside surface.

6. The portfolio of claim 1 further comprising an interior section attached to the first cover so as to at least partially overlie the inside surface thereof and so as to form a first pocket therewith, extending between the top and bottom edges of the cover member and opening toward said central hinge line, said foldable panel comprising an extension of said interior section and separated therefrom by said interior hinge line, said interior section and said foldable panel together comprising a unitary sheet overlying said first cover when said foldable panel is folded thereagainst, and said second cover dimensioned to overlie said foldable panel when said portfolio is in the closed position.

7. A portfolio comprising:

a body of flexible sheet material having a central hinge line disposed intermediate pair of opposed side edges and xtending between top and bottom edges of the body, the central hinge line dividing the body into front and back covers foldable along the hinge line toward and away from each other between closed and open positions, respectively;

a foldable panel hingeably mountable to the front cover so as to be foldable along an interior hinge line intermediate a side edge of the front cover and the central hinge line, said foldable panel having a first surface facing the front cover when folded thereagainst, and a second, opposed surface;

an interior section attached to the front cover so as to at least partially overlie a major surface thereof and so as to form a first pocket therewith, the interior section extending between the top and bottom edges of the body and opening toward the central hinge line, at least a portion of said foldable panel extending into said pocket so as to divide said pocket into two chambers, one on each side of said foldable panel; and a serial array of card-receiving pockets carried on said foldable panel, said card-receiving pockets opening toward said central hinge line when said panel is folded away from said first cover.

8. A portfolio comprising:

a body of sheet-like flexible material having opposed top and bottom edges and a pair of opposed side edges, a central hinge line intermediate the side edges dividing the body into first and second covers, the covers foldable about the central hinge line toward and away from each other between closed and open positions, respectively, the first and second covers having interior surfaces facing each other when the portfolio is in a closed position;

a foldable panel hingeably mounted to the first cover along an interior hinge line located intermediate one side edge of the body and said central hinge line, said foldable panel having a pocket-carrying surface facing the first cover when folded thereagainst;

a serial array of card-receiving pockets carried on the pocket-carrying surface of said foldable panel, said card-receiving pockets opening toward said central hinge line when said panel is folded to face away from said first cover; and an interior section attached to the first cover so as to at least partially overlie the first cover and so as to form a first pocket therewith which opens toward said central hinge line, said interior section comprising an integral extension of said foldable panel and being separated therefrom by an interior hinge line, the interior section and the foldable panel together comprising a unitary sheet overlying the first cover when the foldable panel is folded thereagainst and said second panel dimensioned to overlie said foldable panel when said portfolio is in the closed position.

* * * * *

UNITED STATES PATENT AND TRADEMARK OFFICE

CERTIFICATE OF CORRECTION

PATENT NO. : 4,832,372

DATED : May 23, 1989

INVENTOR(S) : Raymond W. Young

It is certified that error appears in the above-identified patent and that said Letters Patent is hereby corrected as shown below:

IN THE SPECIFICATIONS:

In column 1, line 10, change "peopel" to --people--.

In column 1, line 13, change "pater" to --paper--.

In column 1, line 52, change "in" to --into--.

In column 2, line 1, change "increasing" to --increasingly--.

In column 1, lines 67-68, after "checkbook", delete ",usually by stitching." and insert a period.

In column 2, line 3, after "article" insert a comma.

In column 2, lines 25-26, change "work day" to --workday--.

In column 3, line 8, change "foldabe" to --foldable--.

In column 3, line 23, change "left hand" to --left-hand--.

In column 3, line 38, after the word "to" delete --its--.

In column 3, line 52, change "respectively 14" to --14 respectively--.

In column 4, line 1, change "into" to --over--.

In column 4, line 58, change "is" to --are--.

In column 5, line 32, after "oil" delete the phrase "would of course".

UNITED STATES PATENT AND TRADEMARK OFFICE

CERTIFICATE OF CORRECTION

PATENT NO. : 4,832,372

DATED : May 23, 1989

INVENTOR(S) : Raymond W. Young

It is certified that error appears in the above-identified patent and that said Letters Patent is hereby corrected as shown below:

In column 5, line 34, after "thereto" insert a comma.

In column 5, line 34, after "and" insert the word --it--.

In column 5, line 57, change "bottom-most" to --bottommost--.

In column 6, line 55, after "148" insert a comma.

In column 6, line 56, after the word "material" insert a comma.

In column 6, line 62, change "porton" to --portion--.

In column 7, line 4, after the numeral "8" insert a comma.

In column 7, line 6, change "are" to --is--.

In column 7, line 7, change "linear" to --liner--.

In column 7, line 17, change "packing" to --backing--.

In column 7, line 35, change "a" to --the--. (1st occurrence)

In column 7, line 45, change "having" to --have--.

In column 8, line 5, after the word "investments" insert a comma.

UNITED STATES PATENT AND TRADEMARK OFFICE

CERTIFICATE OF CORRECTION

PATENT NO. : 4,832,372

DATED : May 23, 1989

INVENTOR(S) : Raymond W. Young

It is certified that error appears in the above-identified patent and that said Letters Patent is hereby corrected as shown below:

IN THE CLAIMS:

In column 9, line 55, after the word "intermediate" insert --a--.

In column 9, line 56, change "xtending" to --extending--.

Signed and Sealed this

Twentieth Day of February, 1990

*Attest:*

JEFFREY M. SAMUELS

*Attesting Officer*

*Acting Commissioner of Patents and Trademarks*